US009561885B1

(12) United States Patent
Studee

(10) Patent No.: US 9,561,885 B1
(45) Date of Patent: Feb. 7, 2017

(54) TAMPER RESISTANT CONTAINER

(71) Applicant: PLASTIC INGENUITY, INC., Cross Plains, WI (US)

(72) Inventor: Stephen B. Studee, Cross Plains, WI (US)

(73) Assignee: Plastic Ingenuity, Inc., Cross Plains, WI (US)

( * ) Notice: Subject to any disclaimer, the term of this patent is extended or adjusted under 35 U.S.C. 154(b) by 0 days.

(21) Appl. No.: 14/040,304

(22) Filed: Sep. 27, 2013

(51) Int. Cl.
*B65D 17/34* (2006.01)
*B65D 41/48* (2006.01)

(52) U.S. Cl.
CPC ..... *B65D 41/48* (2013.01)

(58) Field of Classification Search
CPC ..... B65D 41/48; B65D 41/46; B65D 41/50; B65D 41/54; B65D 41/32
USPC ..... 220/270, 315, 324, 326
See application file for complete search history.

(56) References Cited

U.S. PATENT DOCUMENTS

| | | | | |
|---|---|---|---|---|
| 5,092,479 | A * | 3/1992 | Wells | 220/4.23 |
| 8,056,750 | B2 * | 11/2011 | Vovan | 220/270 |
| 2006/0289541 | A1 * | 12/2006 | Boback et al. | 220/266 |
| 2013/0020325 | A1 * | 1/2013 | Stone et al. | 220/270 |

* cited by examiner

*Primary Examiner* — Steven A. Reynolds
*Assistant Examiner* — Javier A Pagan
(74) *Attorney, Agent, or Firm* — Rick L. Abegglen

(57) ABSTRACT

A tamper resistant thermoformed container having a tray and a lid, where the tray has an inside shelf between the cavity floor and a second shelf that extends to a cavity rim, where the lid has a sealing slot formed to engage the inside shelf of the tray, and where the lid also has a latching tab formed to fit into a matching latching hole on the tray. This structure keeps the lid on the tray by a combination of friction between the lid sealing slot and the tray inside shelf, plus interference between the latching tab and the latching hole.

6 Claims, 17 Drawing Sheets

TAMPER RESISTANT CONTAINER

FIELD OF THE INVENTION

This invention relates generally to the field of containers. More particularly, the present invention relates to thermoformed containers having features that enhance the container's ability to resist tampering, and to make evident any tampering which does occur.

BACKGROUND OF THE INVENTION

Thermoformed plastic containers are well known as inexpensive and highly customizable containers for the sale of a wide variety of products, everything from cell phones to deli meats. Thermoformed plastic containers can be transparent and rigid, to let a consumer examine a product closely. They can be lightweight, and may be efficiently stored or shipped together in a nested fashion. It is easy to include product information and cosmetic features in these types of containers, for example with stickers or cards glued to the outside of the containers, with embossing molded into the containers, or with paper inserts inside the containers. For these and other reasons, thermoformed plastic containers can be superior to other available options for product containers, such as cardboard or metal boxes, bags, metal cans, or paper cartons.

Thermoformed containers can include features that make it more difficult to access the contents of the container without being noticed, to form a tamper-resistant container. In a retail electronics setting, for example, tamper-resistance can reduce shoplifting.

In a retail food setting, tamper-resistance can improve food safety by reducing the risk that the product could be partially consumed or contaminated. In retail food settings like a deli counter in a grocery store or in a conventional fast-food or takeout restaurant, it can also be beneficial to provide a container that can be assembled when needed at the point of use, for example after putting a sandwich or other food in the container.

What is needed is a thermoformed container system that includes tamper-resistant features that make it difficult to open without detection, yet easy to open by the end consumer, and preferably allowing assembly on demand by unskilled personnel without specialized machinery or tools.

SUMMARY OF THE INVENTION

A first embodiment of the invention is a thermoformed container system using thermoformed plastic containers, each container having a tray and a lid mounted on the tray, where the tray has a first peripheral shelf between the cavity floor and a second peripheral shelf that extends to a cavity rim, where the lid has a sealing slot formed to engage the first peripheral shelf of the tray, and where the lid has a latching tab formed to fit into a matching latching hole on the tray, so that the lid is retained on the tray by friction between the lid and the tray, plus interference between the latching tab and the latching hole.

In a second embodiment of the invention, the latching tab is formed as part of the tray (instead of being part of the lid), and the latching hole is formed as part of the lid (instead of being part of the tray).

A third embodiment of the invention is a method of forming a container by providing a tray with a first peripheral shelf between the cavity floor and a second peripheral shelf that extends to a cavity rim, where the lid has a sealing slot formed to engage the first peripheral shelf of the tray, and providing a lid for mounting on the tray, where the lid has a latching tab formed to fit into a matching latching hole on the tray, and inserting the tab of the lid into the slot of the tray to form a container with the lid retained on the tray by friction between the lid and the tray and by interference between the latching tab and the latching hole.

Further objects, features, and advantages of the invention will be apparent from the following detailed description when taken in conjunction with the accompanying drawings.

DETAILED DESCRIPTION OF THE INVENTION

FIGS. 1A-1G provide various views of an exemplary tray 20 for a container according to the invention. For purposes of illustration and not as a limitation, the names of the walls of the tray 20 (e.g. floor, top, side, bottom, rear, etc.) assume that the tray 20 is positioned in an upright standing position with the cavity (concave) side of the tray facing upward and with the tray floor 22 on the bottom.

Figure 1A:
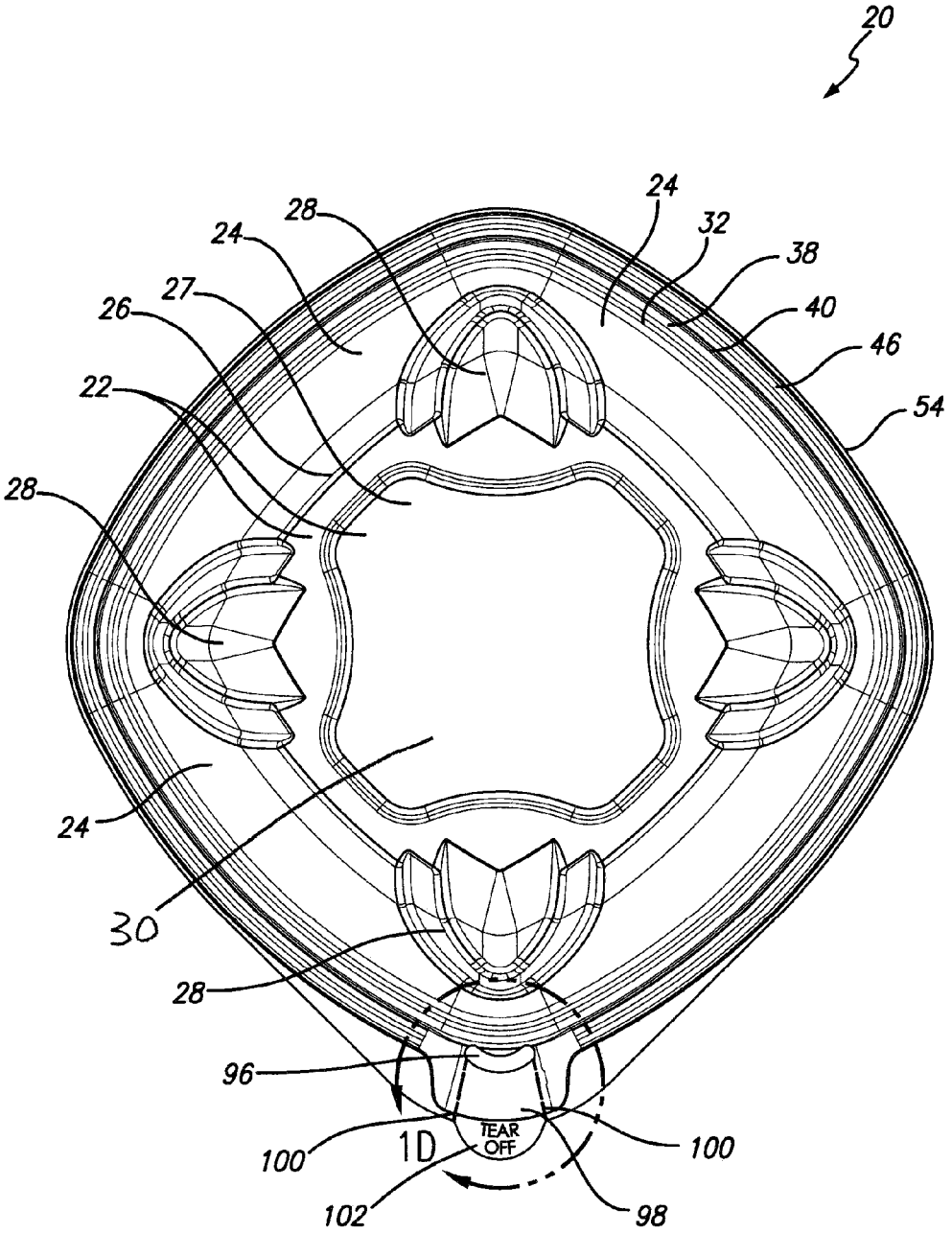
FIGS. 1A, 1B, and 1C are top, bottom, and perspective views, respectively, of an exemplary tray for use in a container according to the invention.
Figure 1B:
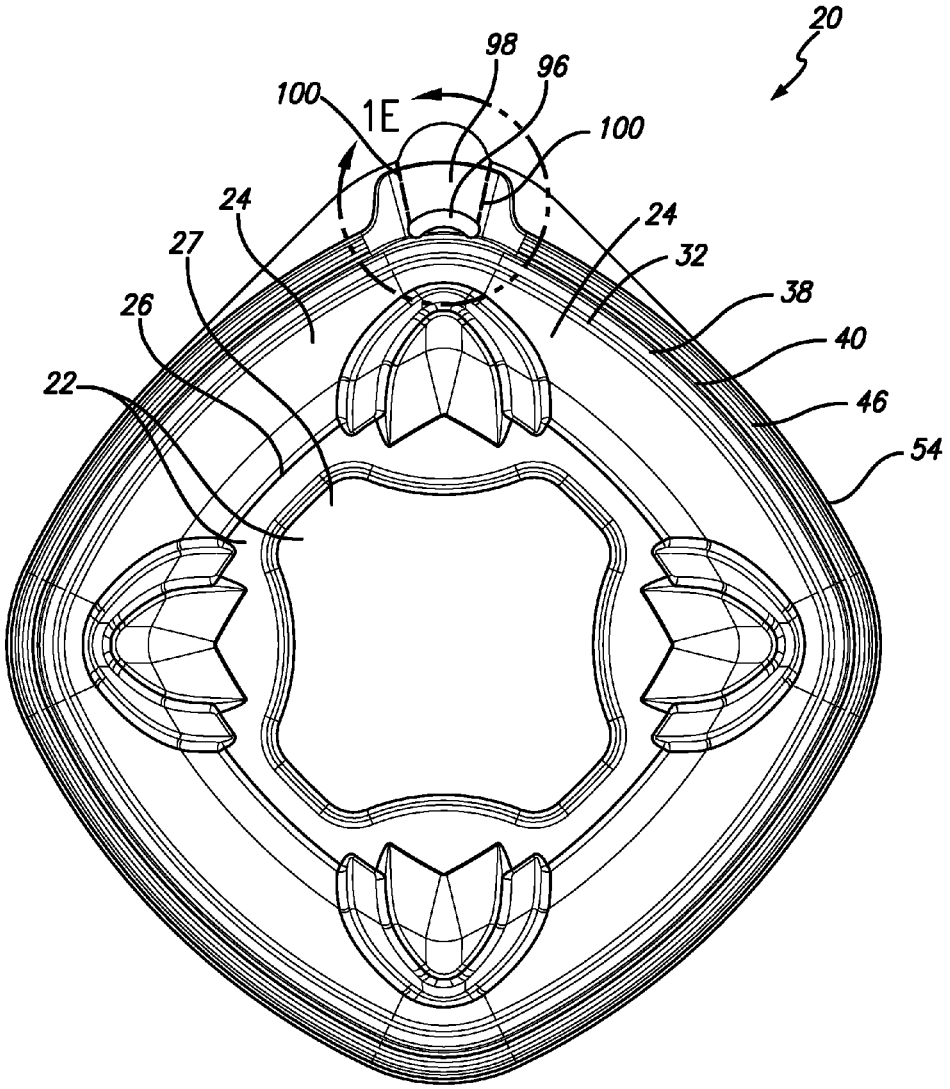
Figure 1C:
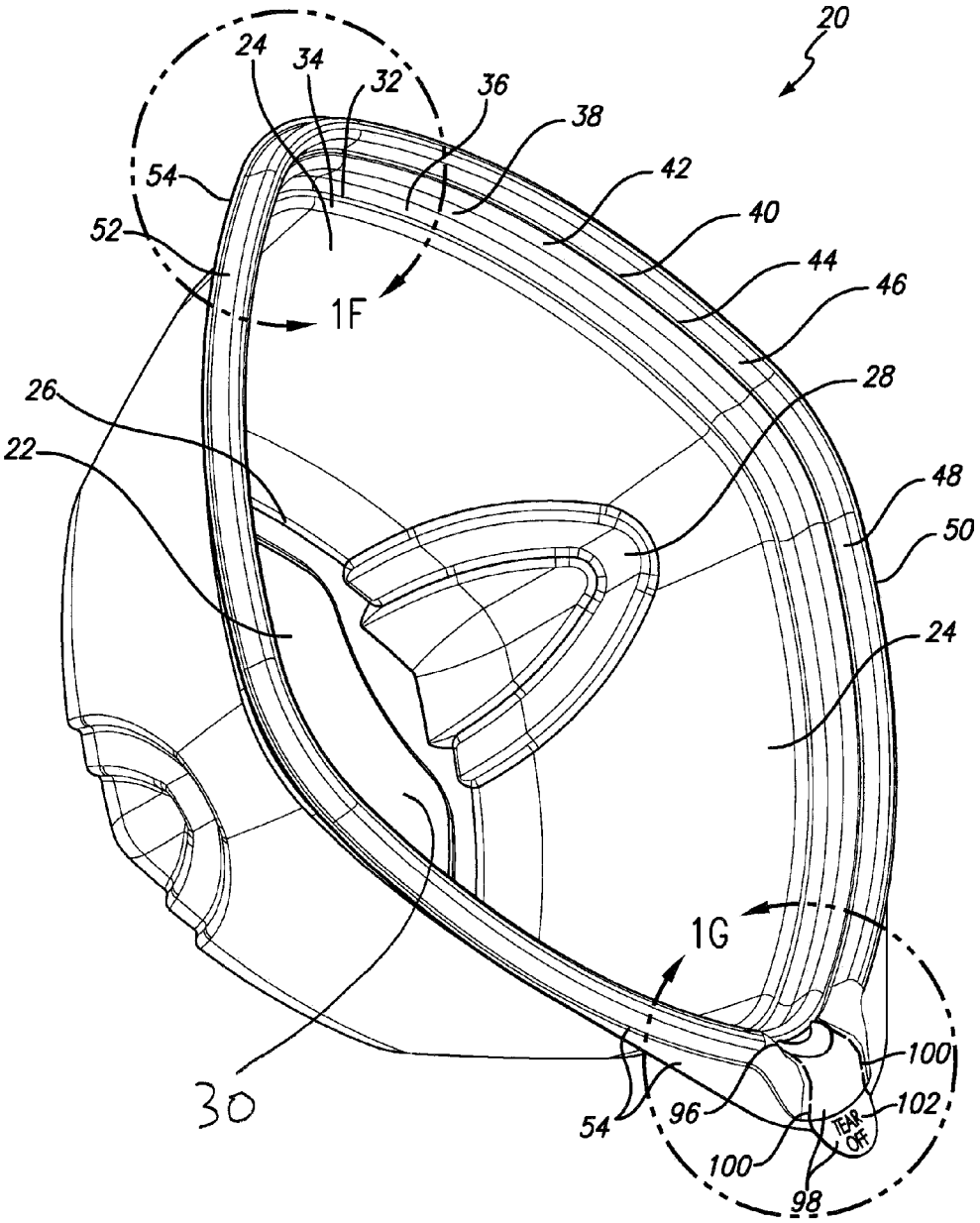

In other words, the names assume the tray 20 is viewed as in FIG. 1A. In that orientation, the exemplary tray 20 can be said to include a floor 22 and multiple first side walls 24 extending from a perimeter 26 of the floor 22 to a cavity rim 46 that surrounds an interior cavity 30. The floor 22 may have a floor indentation 27, however this is not required. The multiple first side walls 24 meet at corners 28, which may include embossed features for rigidity or other structural purposes or for entirely cosmetic purposes.

Figure 1D:
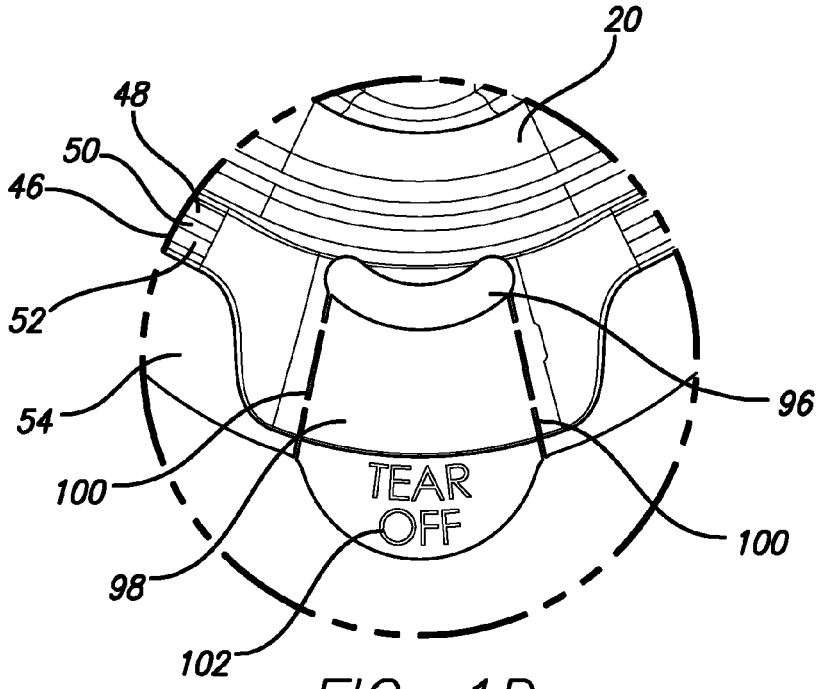
FIGS. 1D and 1E are enlarged views of the region marked 1D in FIG. 1A and the region marked 1E in FIG. 1B, respectively.
Figure 1E:
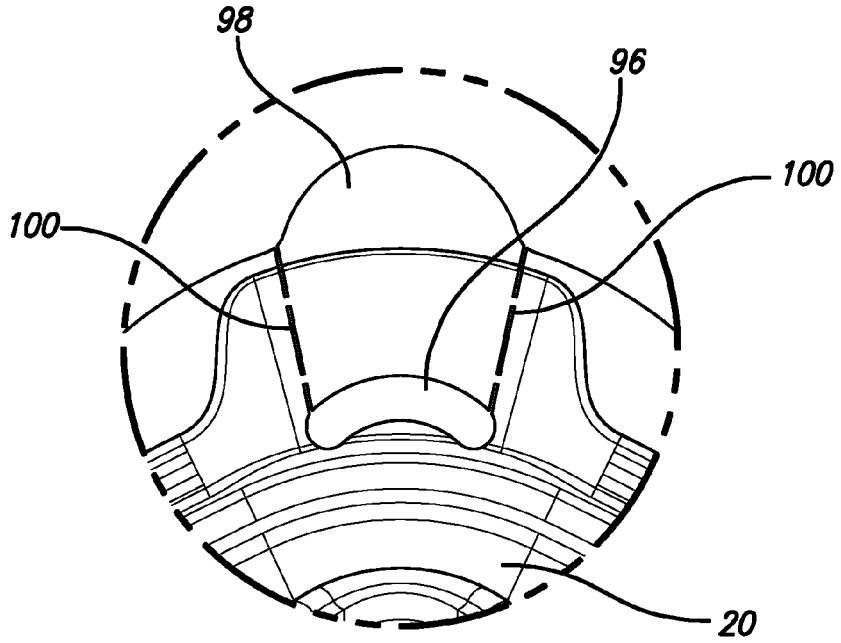
Figure 1F:
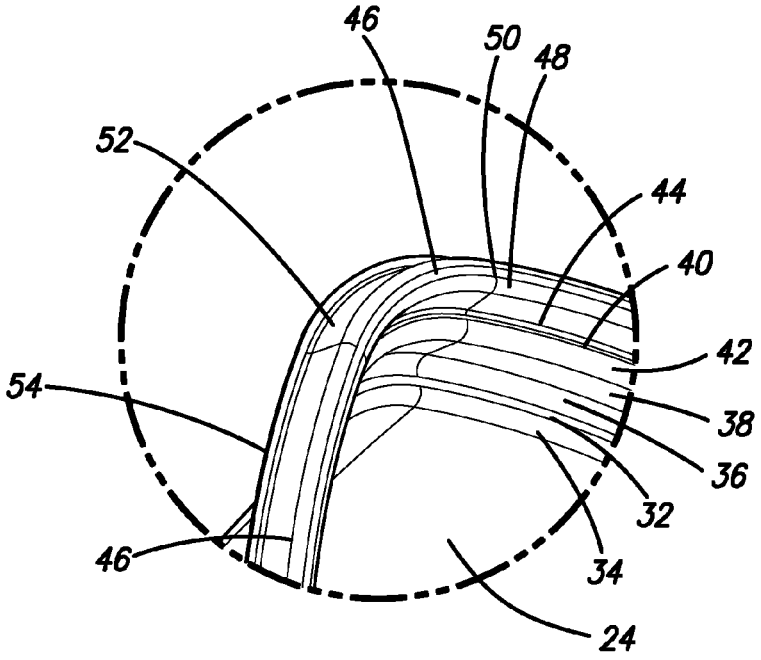
FIGS. 1F and 1G are enlarged views of the regions marked 1F and 1G, respectively, in FIG. 1C.
Figure 1G:
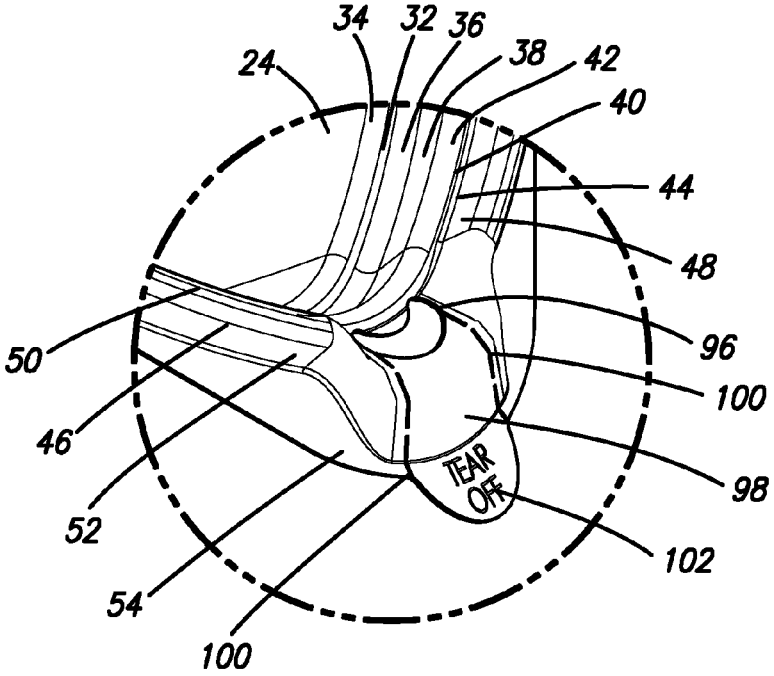
Figure 6:
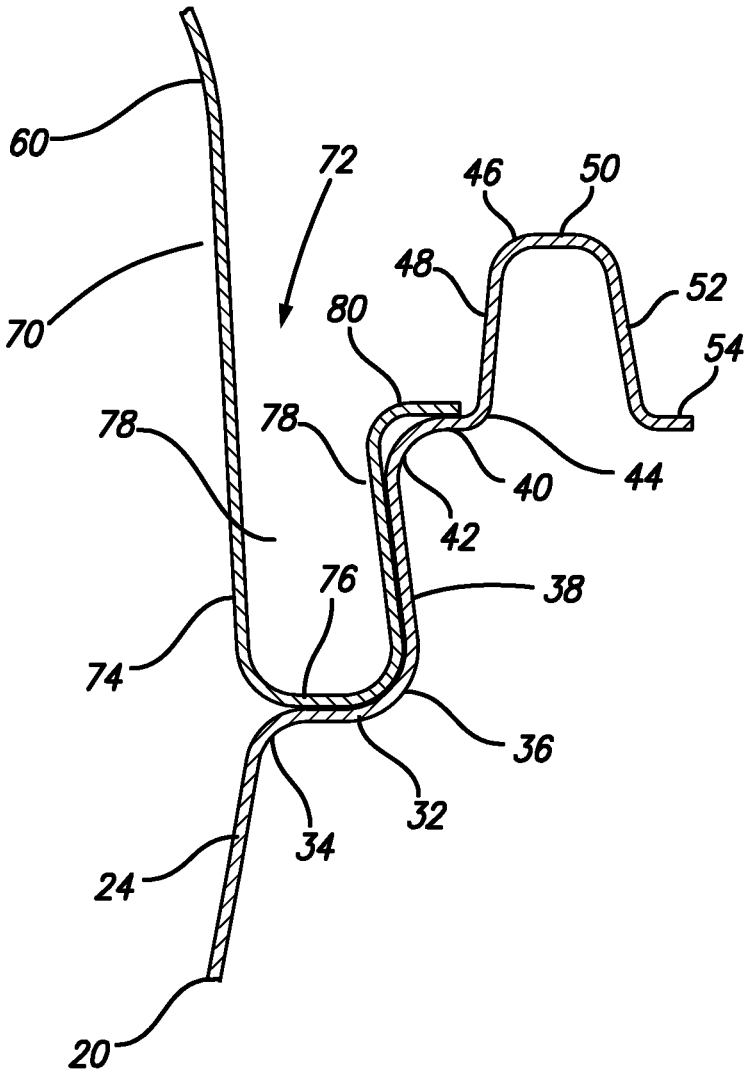
FIG. 6 is a cross-section of the joint between the tray and the lid of the container, taken along the line 6-6 in FIG. 3B.

As perhaps best shown in the cross-sectional view of FIG. 6 and in the zoomed perspective views of FIGS. 1F and 1G, the multiple first side walls 24 extend to a first peripheral shelf 32. The first peripheral shelf 32 has a first peripheral shelf inside boundary 34 and a first peripheral shelf outside boundary 36. The first peripheral shelf 32 extends from the multiple first side walls 24 to the multiple second side walls 38.

The multiple second side walls 38 extend from the first peripheral shelf outside boundary 36 to a second peripheral shelf 40. The second peripheral shelf 40 has a second peripheral shelf inside boundary 42 and a second peripheral shelf outside boundary 44, and extends from the multiple second side walls 38 to the cavity rim 46.

The cavity rim 46 has a cavity rim inside wall 48, a cavity rim top surface 50, and a cavity rim outside wall 52, and terminates in a cavity rim outside wall flange 54.

As perhaps best shown in FIGS. 1D, 1E, and 1G, at least one portion of the tray, preferably a corner 28, includes a hole 96. The tray may include a tear-off portion 98, for example located between the hole 96 and the periphery of the tray formed by the rim 46 and/or the outside flange 54. At least part of the boundary of the tear-off portion 98 may include perforations 100. The tear-off portion 98 or any other portion of the tray 20 may include text 102.

Any of the walls may include one or more embossed wall features for decoration or for structural purposes. Any of the walls may also include one or more raised engravings, for example brand markings, informational messages, or decorations. The engravings can be placed inside a frame.

The exemplary tray 20 can have (by way of example, and not as a limitation) an interior cavity 30 that is between 0.5-2 inches deep from the top surface 50 of the rim 46 to the floor 22 that forms the bottom of the cavity 30. Similarly, the tray 20 can be about 3-8 inches wide to fit typical products such as electronics or foods. However these exact dimensions are not required—the tray could be bigger or smaller, and/or could have different relative dimensions. While the exemplary tray 20 is approximately square when viewed from the top, this particular shape is not required, and the tray 20 could be a different shape, for example rectangular, triangular, ovoid, circular, pentagonal, trapezoidal, etc.

Figure 2A:
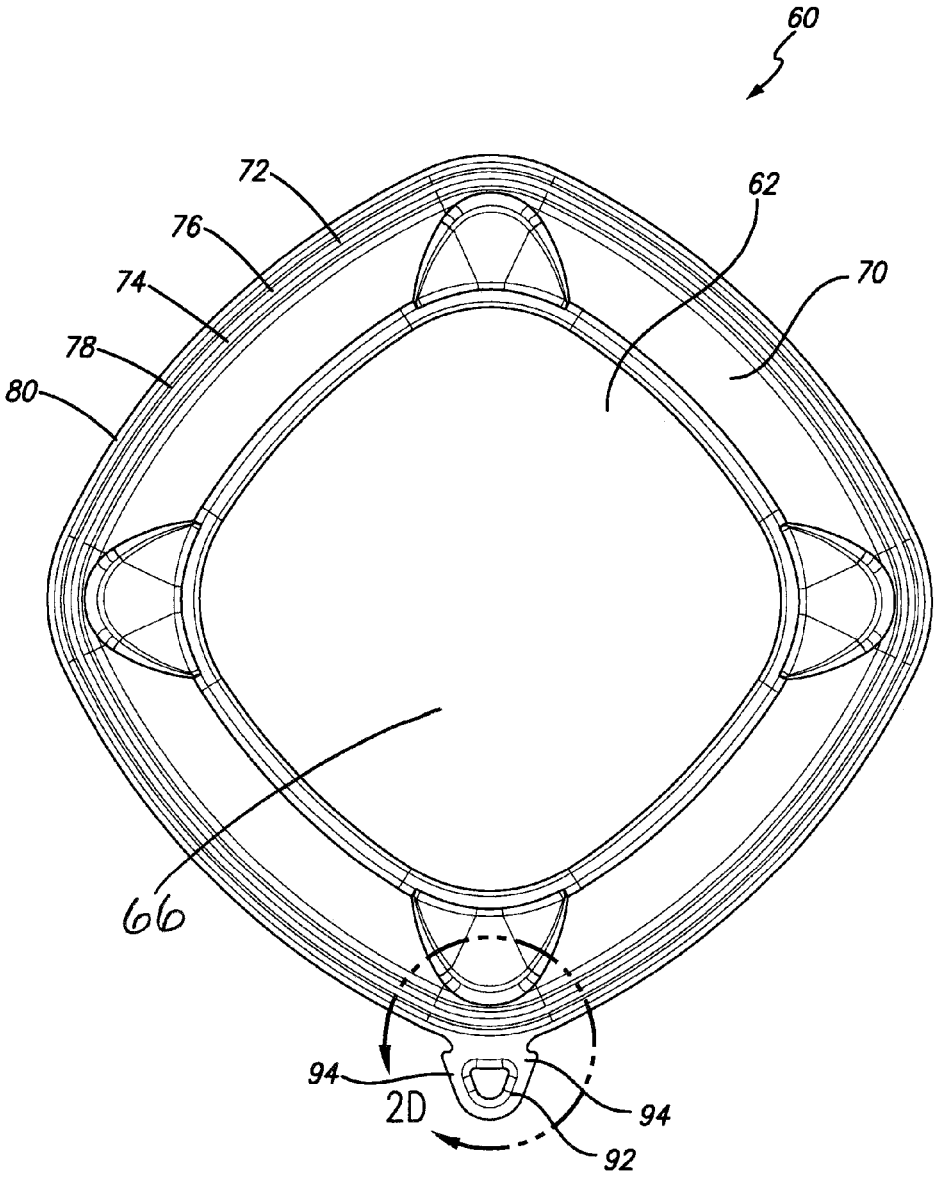
FIGS. 2A, 2B, and 2C are top, bottom, and perspective views, respectively, of an exemplary lid for use in a container according to the invention.
Figure 2B:
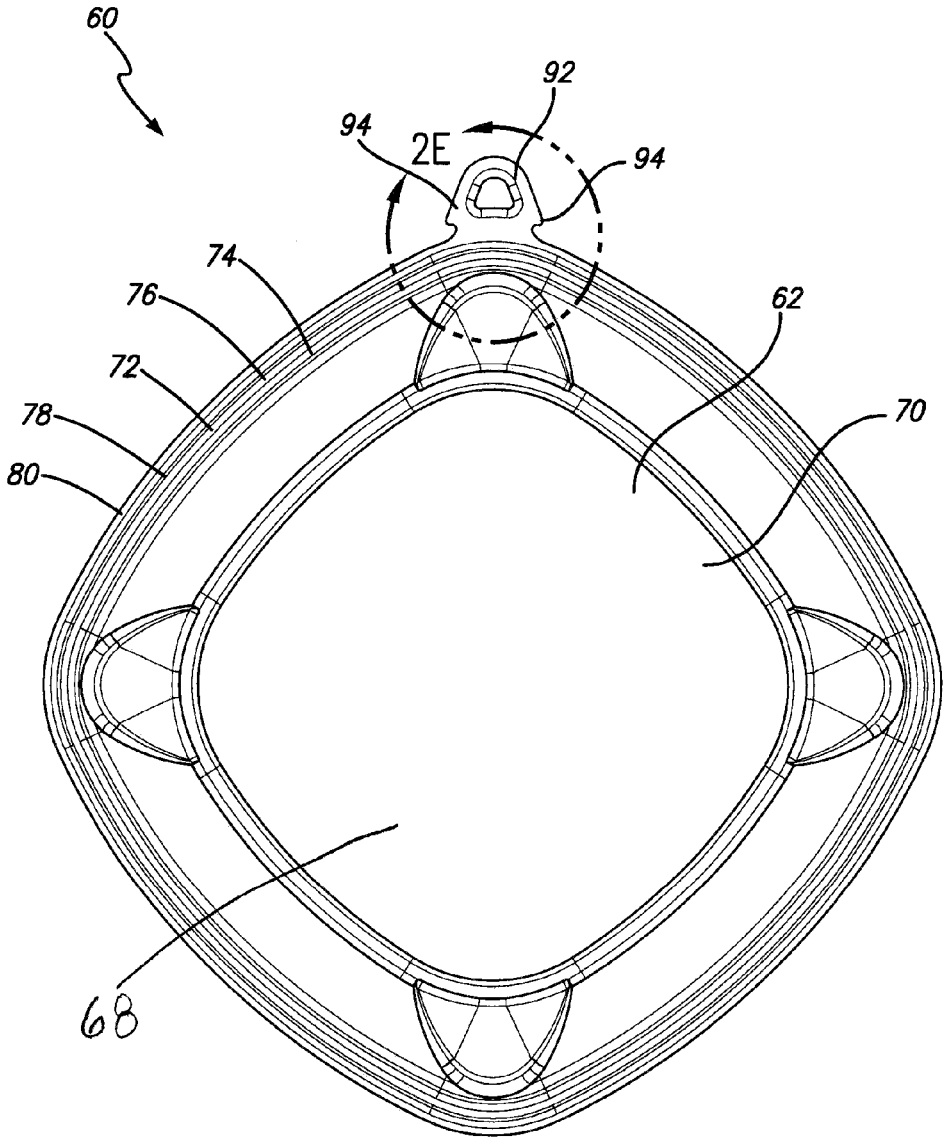
Figure 2C:
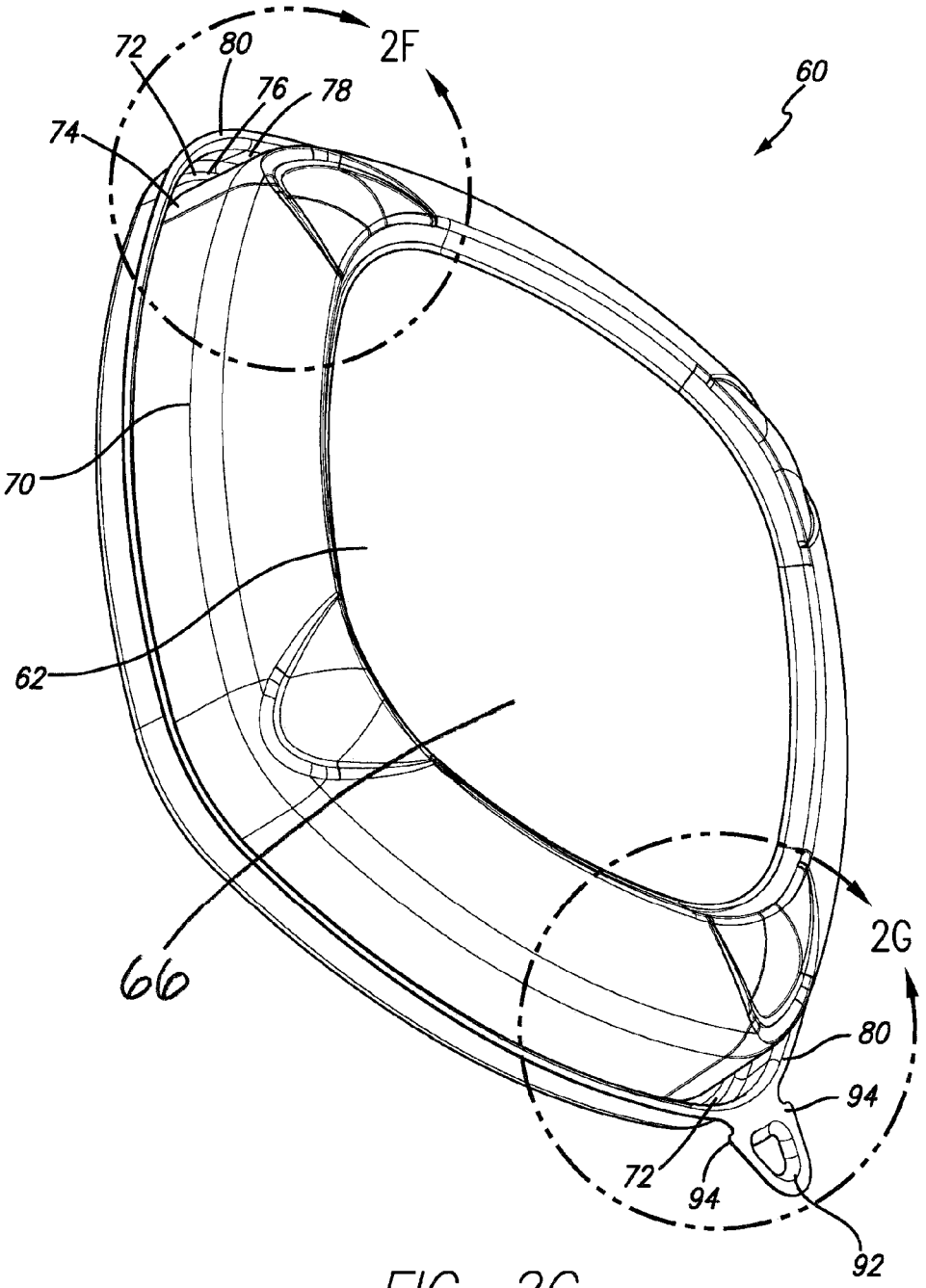

FIGS. 2A-2G provide various views of an exemplary lid 60 for use in a container according to the invention. In FIG. 2A the lid 60 is positioned with the convex side of the central portion 62 of the lid 60 facing upward, as if to cover the tray 20 of FIG. 1A.

The lid 60 includes a central portion 62 that may include engravings, such as brand markings, informational messages, or decorations. The lid 60 has an exterior surface 66 that faces outwardly when the lid 60 is fitted on a tray 20, and an interior surface 68 that faces the interior cavity 30 of the tray 20.

Figure 2D:
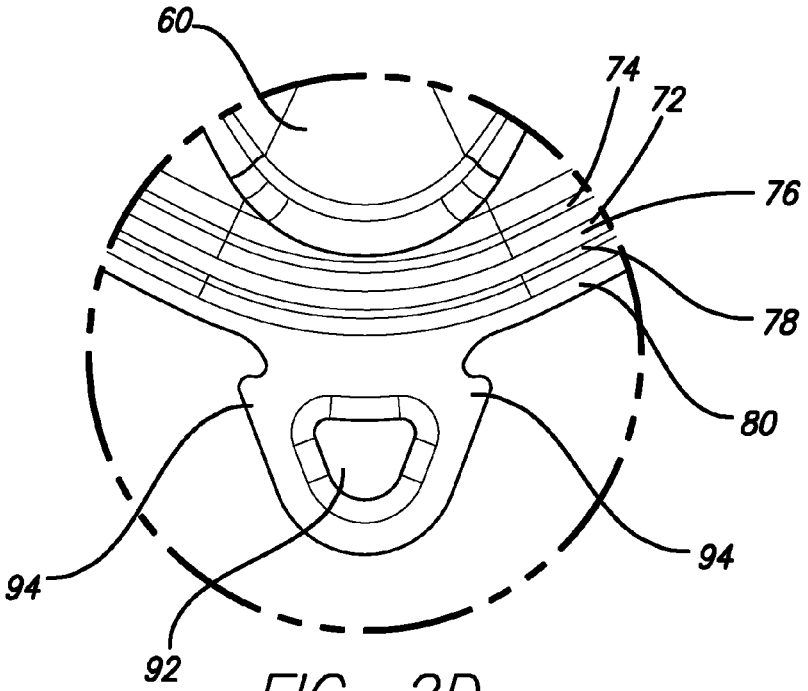
FIGS. 2D and 2E are enlarged views of the regions marked 2D in FIG. 2A and the region marked 2E in FIG. 2B, respectively.
Figure 2E:
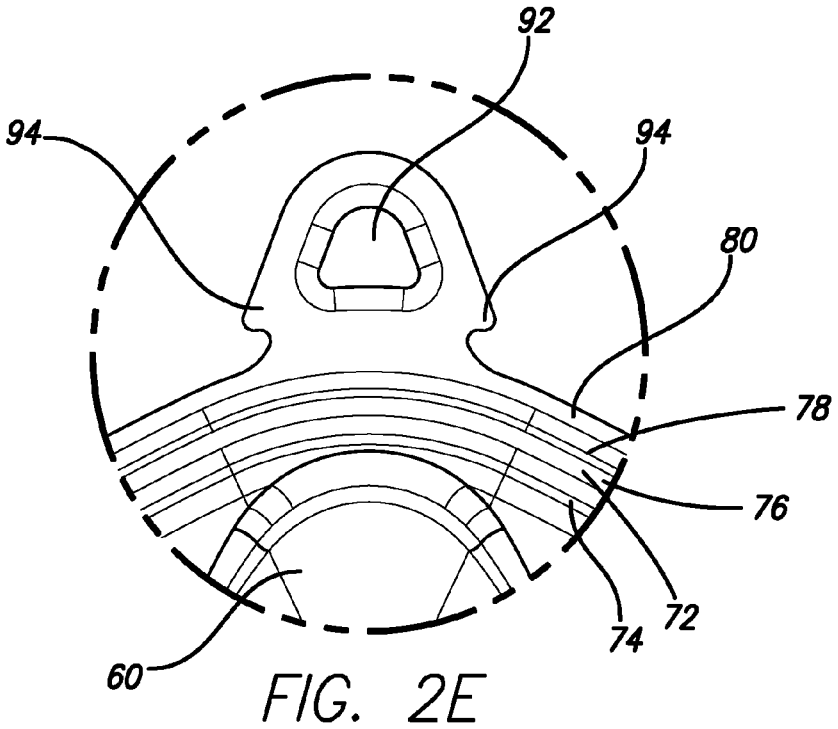
Figure 2F:
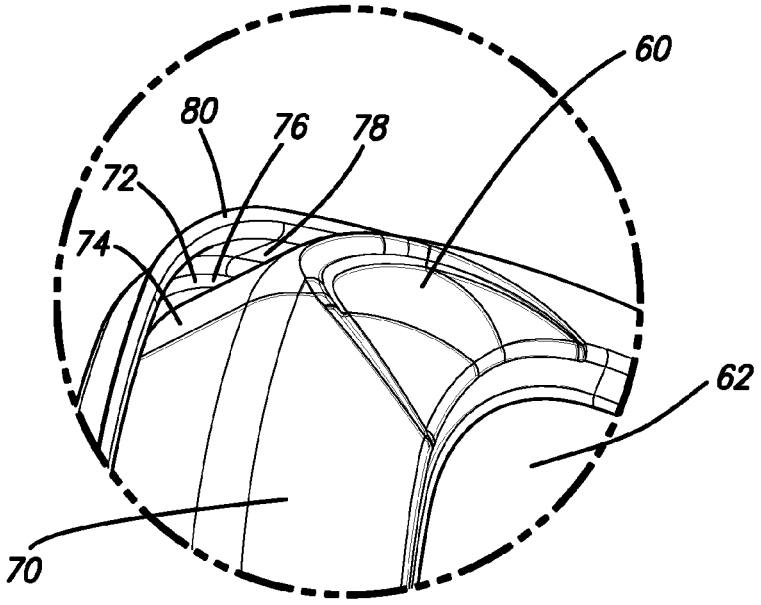
FIGS. 2F and 2G are enlarged views of the regions marked 2F and 2G, respectively, in FIG. 2C.
Figure 2G:
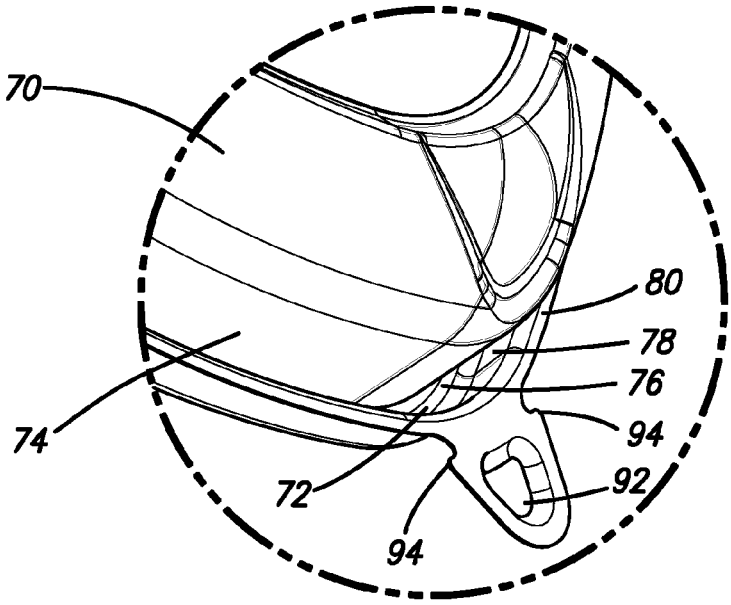

As perhaps best shown in the cross-sectional view of FIG. 6 and in the zoomed perspective views of FIGS. 2F and 2G, the lid 60 includes a lid sealing slot 72, with a sealing slot first side wall 74, a sealing slot floor 76, and a sealing slot second side wall 78. The lid side wall 70 extends from the lid central portion 62 to the sealing slot first side wall 74. The sealing slot floor 76 extends from the sealing slot first side wall 74 to the sealing slot second side wall 78. A lid sealing slot outside flange 80 extends from the sealing slot second side wall 78, and forms the perimeter of the lid 60.

As perhaps best shown in FIGS. 2D, 2E, and 2G, at least one portion of the lid 60, preferably a corner, includes a tab 92 which may include one or more barbs 94.

The lid 60 is preferably sized to fit the tray 20. Like the tray 20, the lid 60 can be roughly square and about 3-8 inches wide, and about 0.5-2 inches high. However, as with the tray, this shape and these exact dimensions are not required—the lid could be a different shape, and it could be bigger or smaller or have different relative dimensions.

Figure 3A:
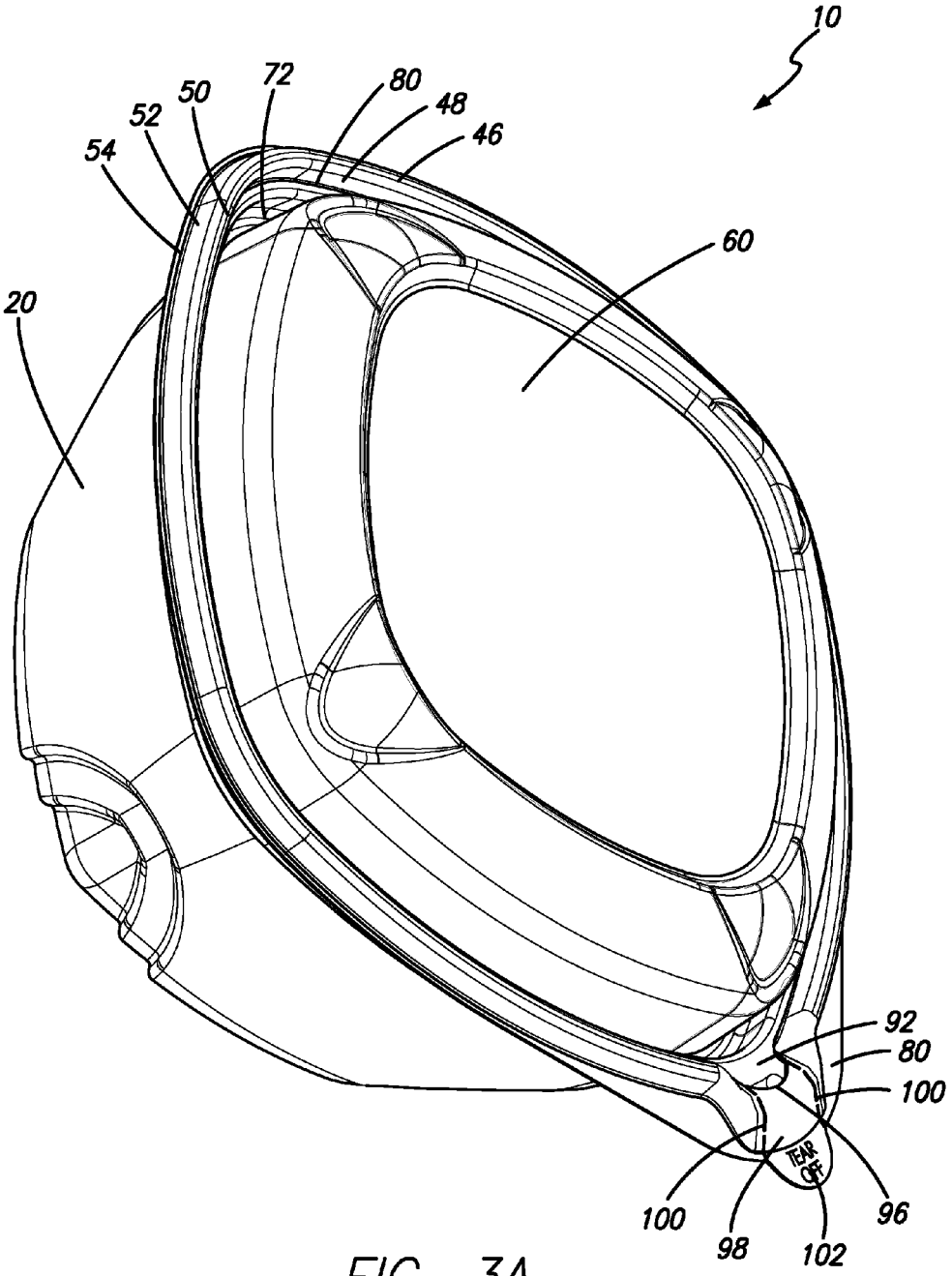
FIGS. 3A and 3B are perspective and top views, respectively of a container according to the invention, comprising the tray of FIGS. 1A-1G and the lid of FIGS. 2A-2G, with tab of the lid inserted into slot of tray.
Figure 3B:
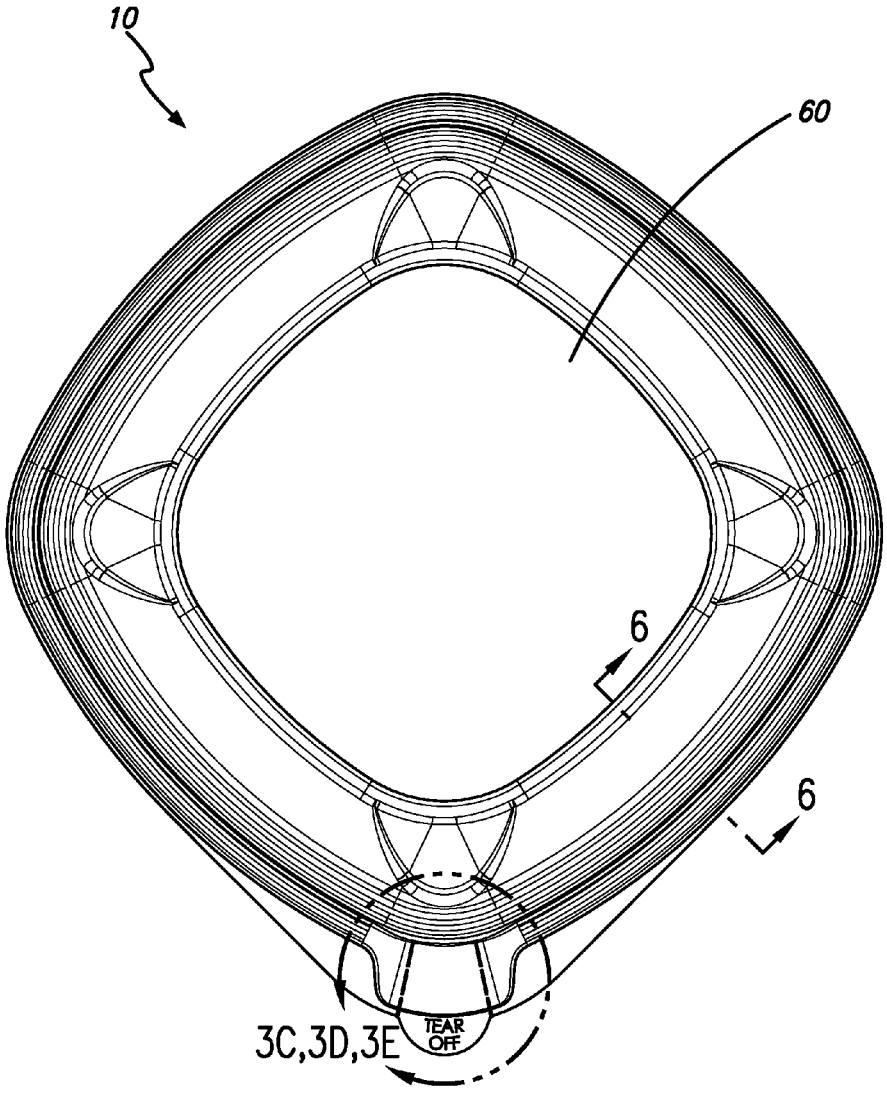
Figure 3C:
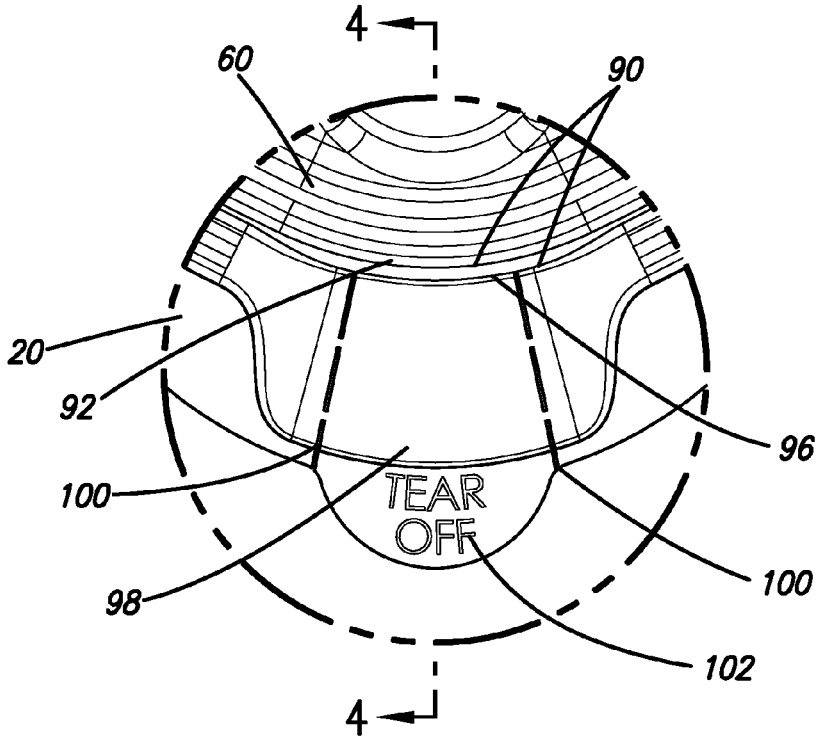
FIG. 3C is an enlarged top view of the region marked 3C in FIG. 3B, with the tear-off portion of the tray intact.
Figure 3D:
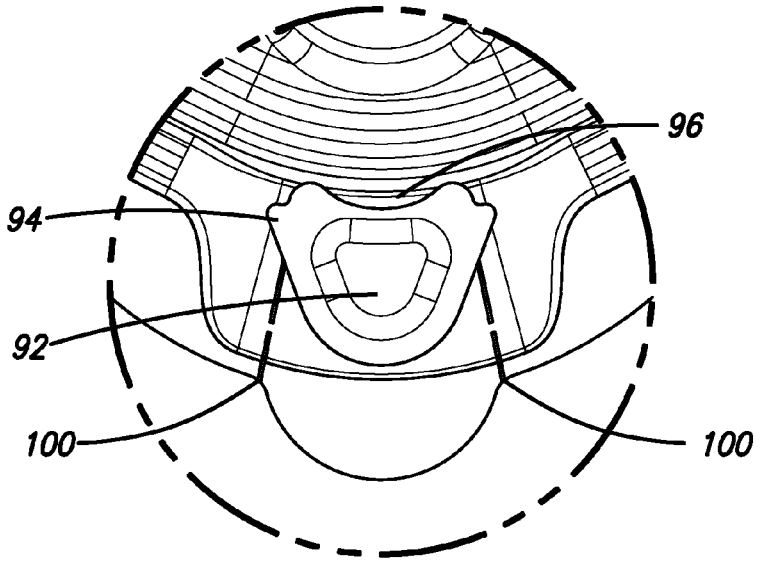
FIG. 3D is an enlarged bottom view of the region marked 3D in FIG. 3B, with the tear-off portion of the tray intact.

FIGS. 3A and 3B are perspective and top views, respectively, of an exemplary container according to the invention comprising the lid of FIG. 2A mounted on the tray of FIG. 1A to form a sealed container 10.

In the container 10, the tab 92 of the lid 60 is inserted in the hole 96 of the tray 20, forming a latch 90 between the lid 60 and the tray 20. (In the present application, the term "sealed" means substantially closed in order to retain contents, not necessarily air tight or completely enclosed.) Additionally, the sealing slot 72 of the lid 60 is nested into the tray 20, with the peripheral flange 80 of the lid buried behind the rim 46 of the tray 20, forming a friction fit to retain the lid 60 on the tray 20.

The seal between the lid 60 and tray 20 is perhaps best illustrated in the cross-section view of FIG. 6, taken at line 6-6 in FIG. 3B. As shown in FIG. 6, the lid sealing slot 72 nests against the first peripheral shelf 32 and second side wall 38 of the tray 20, with the sealing slot floor 76 against the first peripheral shelf 32 and the sealing slot second side wall 78 against the tray second side wall 38. The peripheral flange 80 of the lid 60 preferably nests tightly into the corner between the second peripheral shelf 40 and the cavity rim inside wall 48 of the tray 20.

The cavity rim inside wall 48 may also include one or more convex structures protruding outwardly to provide an interference fit with the peripheral flange 80 of the lid 20 locked under the convex structure. The convex structure could be one or of a post, pin, plug, bulge, bump, hump, pyramid, cube, nub, projection, protrusion, protuberance, knob, ridge, or a combination of these structures.

These features provide tamper resistance by securely retaining the lid 60 on the tray 20 to require a high level of manual dexterity to open the container 10. Also, burying the flange 80 of the lid 60 behind the rim 46 of the tray 20 hides the flange 80, making it difficult to find the edge (i.e. the flange 80) of the lid 60 in order to pry the lid 60 off the tray 20. The friction fit (possibly augmented with an interference fit) helps keep the lid sealed on the tray unless deliberately opened by the consumer, and the serpentine path through this seal between the lid and tray helps to keep any contents inside the cavity.

Figure 3E:
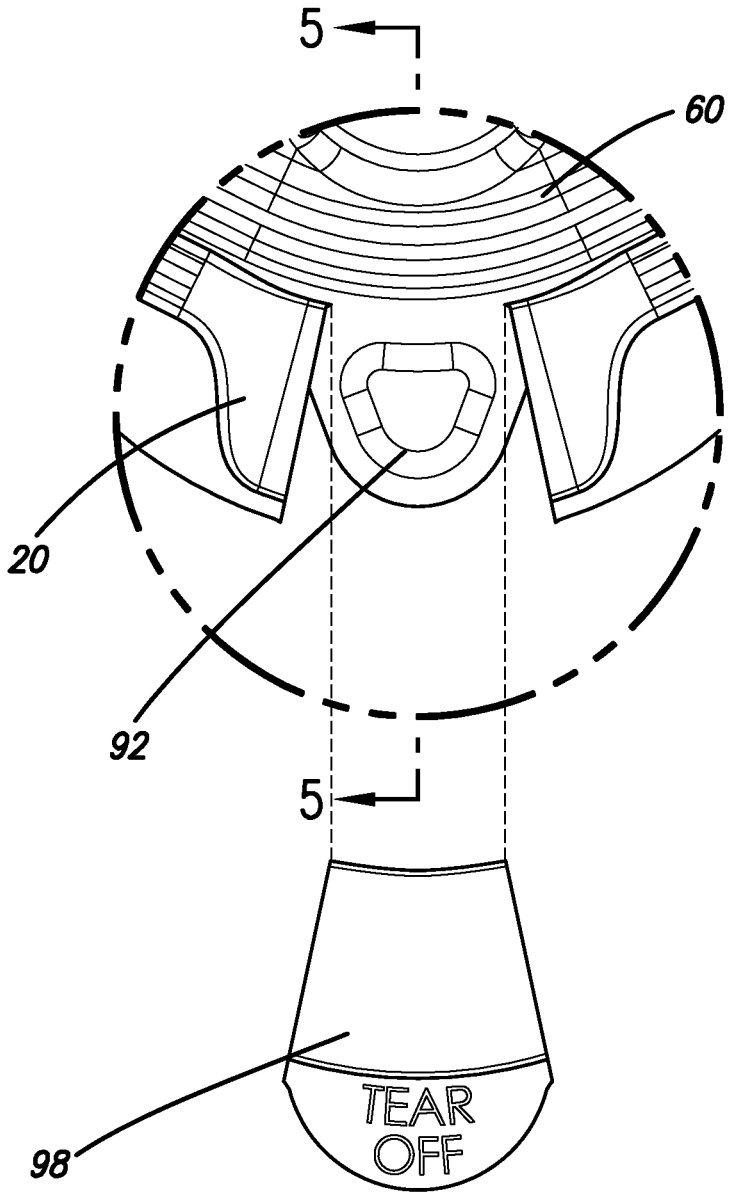
FIG. 3E is an enlarged top view of the region marked 3E in FIG. 3B, with the tear-off portion of the tray separated from the remainder of the tray.
Figure 4:
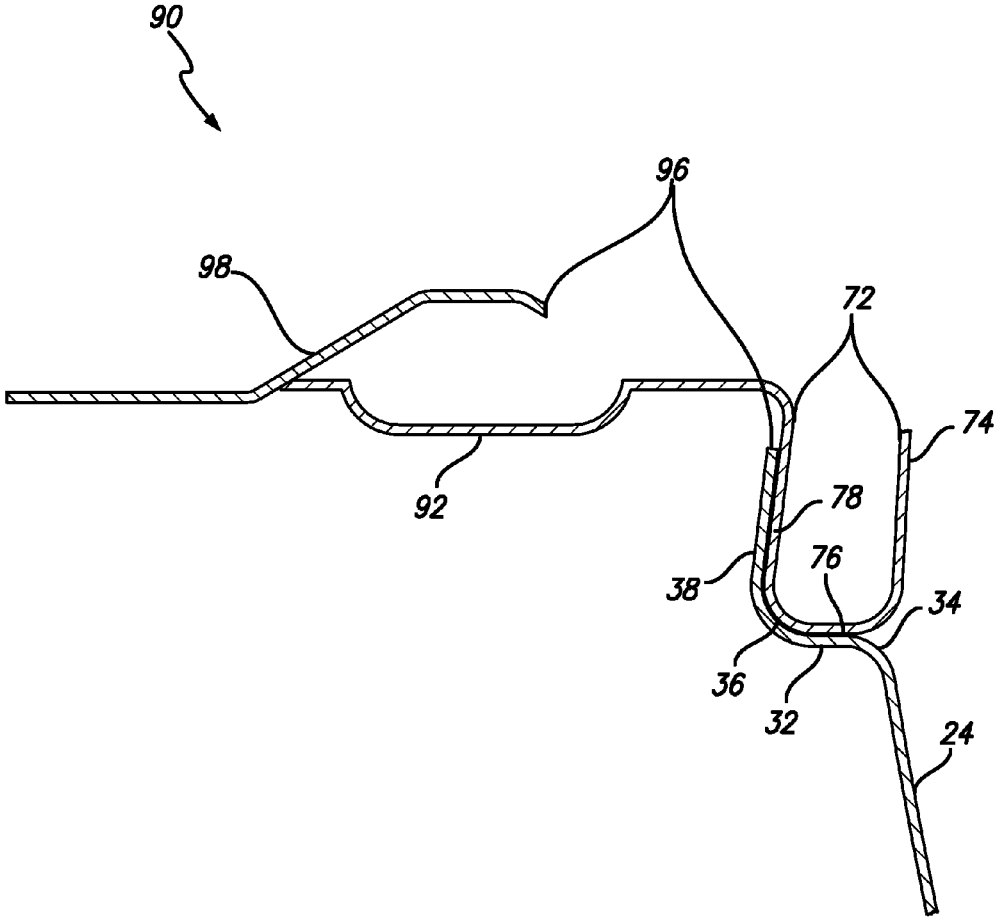
FIG. 4 is a cross-section of the latch region of the container, taken along the line 4-4 in FIG. 3C, with the tear-off portion of the tray intact.
Figure 5:
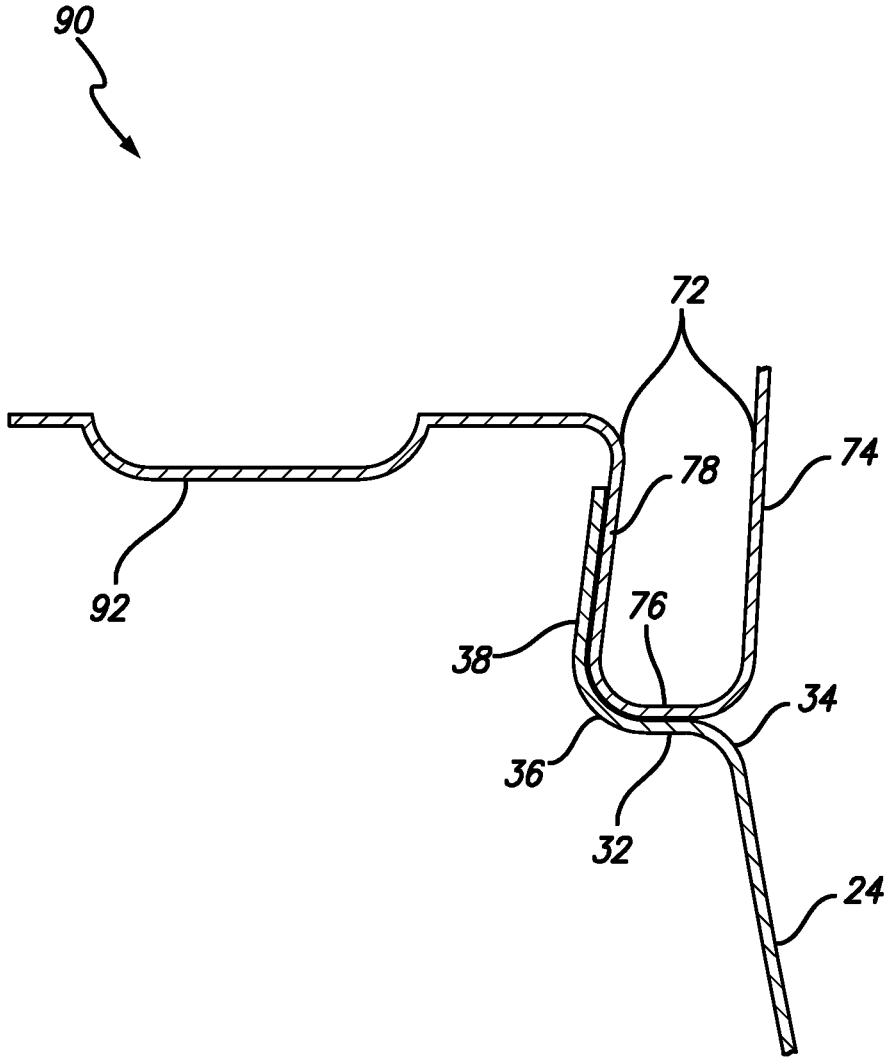
FIG. 5 is a cross-section of the latch region of the container, taken along the line 5-5 in FIG. 3E, with the tear-off portion of the tray removed.

In the condition shown in FIGS. 3A, 3B, 3C, 3D, and 4, the latch 90 retains the lid 60 on the tray 20. In the condition shown in FIGS. 3E and 5, the tear-off portion 98 has been separated from the remainder of the tray 20, facilitating removal of the lid 60 from the tray 20 in order to open the container 10. The use of a tear-off portion 98 also provides tamper resistance, for example by making it obvious when the latch 90 has been broken and preventing repair of the latch once it has been broken.

While the preceding discussion of the exemplary container 10 uses particular embodiments of a tray 20 and lid 60, the invention could be practiced with other tray and lid configurations. The exemplary container 10 includes a single internal cavity 30, but this particular structure is not required. For example, a different number of cavities could be provided for particular applications, and the container as a whole or the individual cavities could be different sizes and/or shapes. While the exemplary container includes a tray with a latching hole and a lid with a latching tab, an alternative embodiment of the invention can have a tray with a latching tab and a lid with a latching hole. While the exemplary container includes a tray with a single latching hole located at a corner, and a lid with a single latching tab located at a corner, there could be multiple latching holes and multiple latching tabs, and the latching tabs and latching holes need not be located at corners.

While the exemplary container includes a tray with a latching hole and a lid with a latching tab, an alternative embodiment of the invention can have a tray with a latching tab and a lid with a latching hole. While the exemplary container includes a tray with a single latching hole, and a lid with a single latching tab, there could be multiple latching holes and multiple latching tabs. While the exemplary container includes a tray with a latching hole located at a corner, and a lid with a latching tab located at a corner, the latching tabs and latching holes could be located at a different position, for example between corners.

The tray 20 and lid 60 of the container 10 are preferably made using thermoforming methods, from a suitable thermoformable material. For example, a tray 20 and lid 60 meant for use with ready-to-eat foods might be formed of a thermoformable plastic such as oriented polystyrene (OPS), talc-filled polypropylene (TFPP), polypropylene (PP), high impact polystyrene (HIPS), polyethylene terephthalate (PET), amorphous PET (APET), crystalline polyethylene (CPET) polystyrene copolymer blends, styrene block copolymer blends, and the like.

The materials forming the tray 20 and lid 60 may be different, and those materials are not necessarily homogeneous, but may be, for example, a laminate, co-extruded material, or multilayer material. Additional components could be used, for example a plastic or foil membrane could be positioned on the tray 20 and covering the contents 110 in a way that allows the lid 60 to be fastened on the tray.

It is understood that the invention is not confined to the embodiments set forth herein as illustrative, but embraces all such forms thereof that come within the scope of the following claims.

What is claimed is:

1. A tamper-resistant container, comprising:

a tray, made of thermoformed plastic, with a cavity having a cavity floor and a plurality of tray first side walls integrally formed with and extending from the cavity floor, wherein the tray first side walls extend to a first peripheral shelf surrounding at least a portion of the cavity and extending to a plurality of tray second side walls;

and wherein the tray second side walls extend to a second peripheral shelf surrounding at least a portion of the cavity and extending to a cavity rim inside wall, the cavity rim inside wall extending to a cavity rim;

and a lid, made of thermoformed plastic, with a central portion and a plurality of lid side walls integrally formed with and extending from the central portion;

wherein the lid side walls extend to a lid sealing slot surrounding at least a portion of the central portion, wherein the lid sealing slot has a sealing slot first side wall, a sealing slot floor, and a sealing slot second side wall extending to a sealing slot outside flange; and wherein the lid sealing slot is formed to engage the tray with the sealing slot floor against the first peripheral shelf of the tray and the sealing slot second side wall against the second side wall of the tray; and wherein the lid has at least one latching tab and the tray has a latching hole formed to receive the latching tab, whereby the lid can be engaged with the tray by a combination of a friction between the tray and the lid sealing slot and an interference between the latching tab inserted into the latching hole; and wherein the cavity rim inside wall extends outwardly and upwardly from the second peripheral shelf whereby the cavity rim inside wall does not interfere with removal of the lid when the lid is engaged with the tray.

2. The tamper-resistant container of claim 1 wherein at least one latching hole of the tray is adjacent to a tear-off portion.

3. The tamper-resistant container of claim 1 wherein the cavity rim of the tray includes a cavity rim inside wall and wherein at least a portion of the sealing slot outside flange is formed to extend toward the cavity rim inside wall when the lid is engaged with the tray.

4. The tamper-resistant container of claim 1 wherein the latching tab includes one or more barbs.

5. The tamper-resistant container of claim 1 wherein the tray has a plurality of tray corners with at least one latching hole located at a tray corner, and wherein the lid has a plurality of lid corners with at least one latching tab located at a lid corner.

6. The tamper-resistant container of claim 5 wherein the tray has a single latching hole located at a single tray corner, and the lid has a single latching tab located at a single lid corner.

* * * * *